US009182117B2

(12) United States Patent
Rathmann et al.

(10) Patent No.: US 9,182,117 B2
(45) Date of Patent: Nov. 10, 2015

(54) LANCE OF A GAS TURBINE BURNER

(75) Inventors: Ulrich Rathmann, Baden (CH); Daniel Burri, Rothenburg (CH); Thorsten Motzkus, Birmenstorf (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 437 days.

(21) Appl. No.: 13/107,135

(22) Filed: May 13, 2011

(65) Prior Publication Data

US 2011/0284669 A1 Nov. 24, 2011

(30) Foreign Application Priority Data

May 20, 2010 (EP) ..... 10163443

(51) Int. Cl.

| | |
|---|---|
| ***B05B 1/14*** | (2006.01) |
| ***F23D 11/10*** | (2006.01) |
| ***F23D 14/22*** | (2006.01) |
| ***F23D 17/00*** | (2006.01) |
| ***F23R 3/28*** | (2006.01) |

(52) U.S. Cl.

CPC ..... *F23D 11/106* (2013.01); *F23D 14/22* (2013.01); *F23D 17/002* (2013.01); *F23R 3/28* (2013.01); *F23C 2900/07021* (2013.01); *F23C 2900/07022* (2013.01)

(58) Field of Classification Search

CPC ..... B05B 1/14; F23D 14/48; F23D 14/22
USPC ..... 431/159, 8; 239/548, 423, 424, 424.5
IPC ..... B05B 1/14; F23D 14/48
See application file for complete search history.

(56) References Cited

U.S. PATENT DOCUMENTS

| | | | | |
|---|---|---|---|---|
| 3,604,832 | A * | 9/1971 | Kohler et al. | 174/15.5 |
| 4,368,940 | A * | 1/1983 | Sugiura | 439/170 |
| 4,890,793 | A * | 1/1990 | Fuglistaller et al. | 239/427 |
| 5,309,813 | A * | 5/1994 | Henley | 86/23 |
| 5,361,578 | A * | 11/1994 | Donlan | 60/800 |
| 5,437,413 | A * | 8/1995 | Shen et al. | 239/424.5 |
| 5,487,659 | A * | 1/1996 | Eroglu et al. | 431/350 |
| 6,325,618 | B1 * | 12/2001 | Benz et al. | 431/187 |
| 6,402,059 | B1 * | 6/2002 | Benz et al. | 239/422 |
| 8,012,436 | B2 * | 9/2011 | Van Den Berg et al. | 422/647 |
| 8,074,900 | B2 * | 12/2011 | Brown | 239/429 |
| 2007/0207425 | A1 * | 9/2007 | Brautsch et al. | 431/159 |
| 2010/0236246 | A1 * | 9/2010 | Buss et al. | 60/740 |
| 2012/0055162 | A1 * | 3/2012 | Eroglu et al. | 60/740 |

FOREIGN PATENT DOCUMENTS

FR 2834774 A1 7/2003

OTHER PUBLICATIONS

European Patent Office, First Examination Report in European Patent Application No. 10163443.4 (Nov. 5, 2010).

* cited by examiner

*Primary Examiner* — Avinash Savani
(74) *Attorney, Agent, or Firm* — Buchanan Ingersoll & Rooney PC

(57) ABSTRACT

A lance of a gas turbine burner includes an inner duct having inner nozzles; an annular outer duct encircling the inner duct and having outer nozzles; and a spacer disposed between a terminal portion of the inner duct and a terminal portion of the outer duct, the spacer being fixed to both the inner duct and the outer duct.

18 Claims, 2 Drawing Sheets

LANCE OF A GAS TURBINE BURNER

CROSS REFERENCE TO PRIOR APPLICATIONS

Priority is claimed to European Patent Application No. EP 10163443.4, filed May 20, 2010, the entire disclosure of which is incorporated by reference herein.

TECHNICAL FIELD

The present invention relates to a lance of a gas turbine burner.

In particular the gas turbine burner is the second burner of a sequential combustion gas turbine engine, i.e. a burner into which hot gases generated in a first combustion chamber but still rich in oxygen pass through, such that a fuel that is injected thereinto increases its temperature and spontaneously burns.

BACKGROUND OF THE INVENTION

Burners of the kind described usually have a cylindrical body into which a lance projects.

The lance is L-shaped and is usually provided with two or also more than two (i.e. three) coaxial ducts having nozzles at their ends.

During operation the nozzles must have substantially coaxial axes; this feature is of great importance, because through the inner duct a fuel (either liquid or gaseous fuel) passes through, to be injected through the nozzles, and through the outer duct air passes through, to be injected together with the fuel (this is the so called shielding air).

It is clear that in case the axes of the nozzles are not correctly aligned, fuel and air are not injected correctly and fuel penetration into the hot gases could be negatively affected.

SUMMARY OF THE INVENTION

In order to connect together the inner and the outer duct, typically the outer duct is provided with a flange at its terminal portion that slidingly rests on the inner duct.

Nevertheless this flange withstands large forces that urge it; for example these forces are generated by the fuel and air flowing in the inner and outer ducts. In addition, the terminal portions of the ducts (where the nozzles are located) withstand high thermal loads, caused for example by the hot gases flowing in the burner. These thermal loads cause deformations, which may be amplified in case different materials, having different thermal expansion coefficients, are used.

For these reasons, during operation deformation of those components at the terminal portion of the lance and, as a consequence, shifting of the axes of the nozzles of the inner and outer ducts from the correct relative position, may occur.

An aspect of the present invention is to provide a lance by which the said problems of the known art are eliminated.

An aspect of the invention is to provide a lance having at least an inner duct with inner nozzles and an outer duct with outer nozzles, with the inner and outer nozzles that are substantially aligned and have their axes in a prefixed relative position. During operation no or a very limited shifting of the axes of the substantially aligned inner and outer nozzles, from the correct prefixed relative position, occur.

BRIEF DESCRIPTION OF THE DRAWINGS

Further characteristics and advantages of the invention will be more apparent from the description of preferred but non-exclusive embodiments of the lance, illustrated by way of non-limiting example in the accompanying drawings, in which.

DETAILED DESCRIPTION OF EMBODIMENTS OF THE INVENTION

Figure 1:
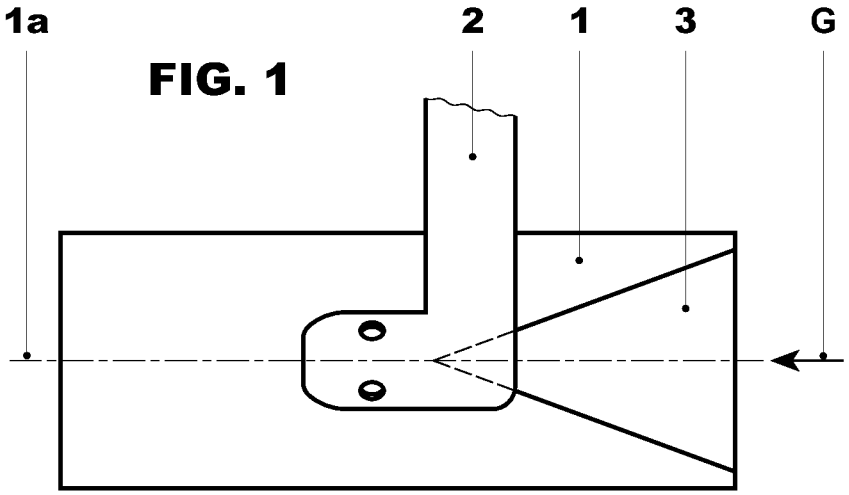
FIG. 1 is a sketch of burner being the second burner of a sequential combustion gas turbine.

With reference to the figures, a burner being the second burner of a sequential combustion gas turbine comprises a channel 1 typically having a rectangular or trapezoidal shape, into which a lance 2 extends; in addition, upstream of the lance 2 also vortex generators 3 are provided (in FIG. 1 the arrow G indicates the direction according to which the hot gases circulate through the channel 1).

The lance 2 is L-shaped and has a terminal portion extending parallel to the flow direction of the hot gases.

In particular, the lance 1 comprises an inner duct 10 with inner nozzles 11; through this duct a fuel passes through, for example gaseous or liquid fuel.

In addition, the lance 1 also has an annular outer duct 12 that encircles the inner duct 10 and is provided with outer nozzles 13; through this duct air passes through, that during operation is injected together with the fuel (i.e. this is the so called shielding air that allows the fuel to penetrate into the hot gases to improve mixing).

The inner and the outer nozzles 11, 13 are provided with axes having a predefinite relative position, i.e. they are coaxial or slightly shifted with respect to one another (i.e. a small offset may be provided therebetween), such that during operation, because of the different thermal expansion of the parts, the axes of the nozzles 11 and 13 are substantially coaxial; for sake of clarity in the attached figures the axes of the inner and outer nozzles 11, 13 are shown as overlapping axes and are all identified by the reference 14. As used herein, coaxial means substantially coaxial.

In particular the nozzles 11, 13 are arranged to inject fuel and air in a transversal direction within the channel 1 and, in this respect, the axis 14 is at an angle (preferably perpendicular) to the longitudinal axis 1*a* of the terminal portion of the lance 2 (in the embodiments shown this axis 1*a* overlaps the longitudinal axis of the channel 1, but may also be apart from it).

Between a terminal portion of the inner duct 10 and a terminal portion of the outer duct 12 a spacer 15 is provided that is fixed to both the inner duct 10 and outer duct 12. Since the spacer 15 is fixed to the terminal portions of the inner and outer ducts 12 no relative movement thereof is possible and, thus, no displacement of the axes of the inner and outer nozzles 11, 13 from the correct position is possible.

Preferably, the spacer 15 extends from the outer duct 12 (i.e. it is realised in one piece with it or it is permanently connected to it, for example by welding) and rests in a seat 16 of the inner duct 10; in addition a fixing element 17 blocking the spacer 15 in the seat 16 is also provided.

Also different embodiments are possible and, in particular, the spacer 15 may extend from the inner duct 10 (i.e. it is realised in one piece with it or it is permanently connected to it, for example by welding) and rest in a seat 16 of the outer duct 12; also in this case a fixing element 17 blocking the spacer 15 in the seat 16 is provided.

The spacer 15 is defined by a collar having through holes 18 allowing the air circulating in the outer duct 12 to pass through.

Figure 5:
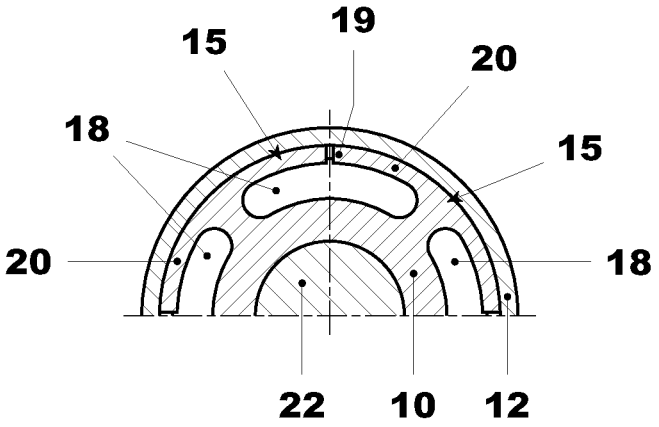
FIG. 5 is a cross section through line V-V of FIG. 4.

In addition, the collar 15 also has slits 19 defining a plurality of separate, all equal elements 20 that extend from the outer duct 12 (FIG. 3) or inner duct 10 (FIG. 5).

As shown, the collar 15 is located between the end of the inner duct 10 and the inner nozzles 11 and, correspondingly, between the end of the outer duct 12 and the outer nozzles 13.

As shown in the figures, the seat 16 is defined by a shoulder and the fixing element 17 is defined by a ring, preferably a threaded ring screwed to a corresponding part of the inner or outer duct 10, 12.

In the following three examples of lance are described in detail.

EXAMPLE 1

Figure 2:
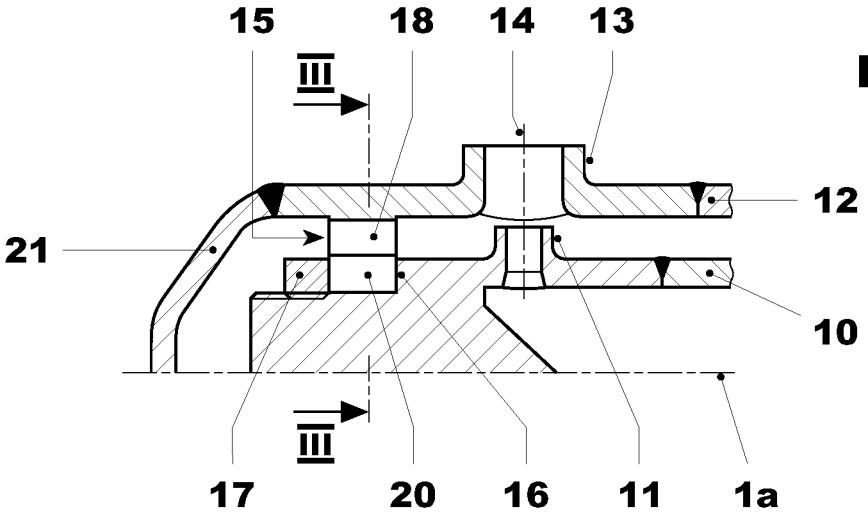
FIG. 2 is a schematic longitudinal section of a terminal portion of a lance in a first embodiment of the invention with a collar extending from an outer duct.
Figure 3:
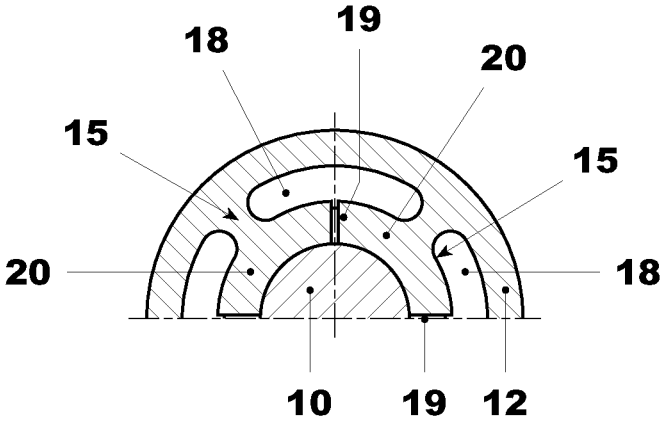
FIG. 3 is a cross section through line III-III of FIG. 2.

The first embodiment of lance 1 is shown in FIGS. 2 and 3.

In this embodiment the collar 15 extends from the outer duct 12 and the seat 16 is provided in the inner duct 10.

The ring 17 is a threaded ring that is screwed to a corresponding threaded terminal portion of the inner duct 10.

In addition, in this embodiment the outer duct 12 has a terminal portion closed by a wall 21 being a separate element from the outer duct 12 and connected thereto, for example by welding.

EXAMPLE 2

Figure 4:
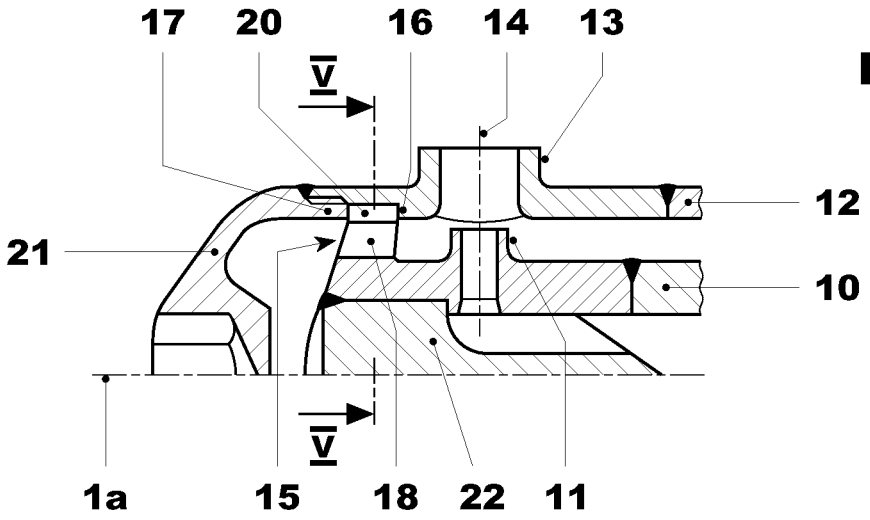
FIG. 4 is a schematic longitudinal section of a terminal portion of a lance in a second embodiment of the invention with a collar extending from an inner duct.

The second embodiment of the lance 1 is shown in FIGS. 4 and 5.

In this embodiment the collar 15 extends from the inner duct 10 and the seat 16 housing it is provided in the outer duct 12.

The ring 17 extends from a wall 21 closing the outer duct 12; this wall 21 is a separate element from the outer duct 12 and is connected thereto.

In particular the ring 17 is a threaded ring that is screwed to a corresponding threaded terminal portion of the outer duct 12; after screwing also a welding, to secure the connection, may be applied.

EXAMPLE 3

Figure 6:
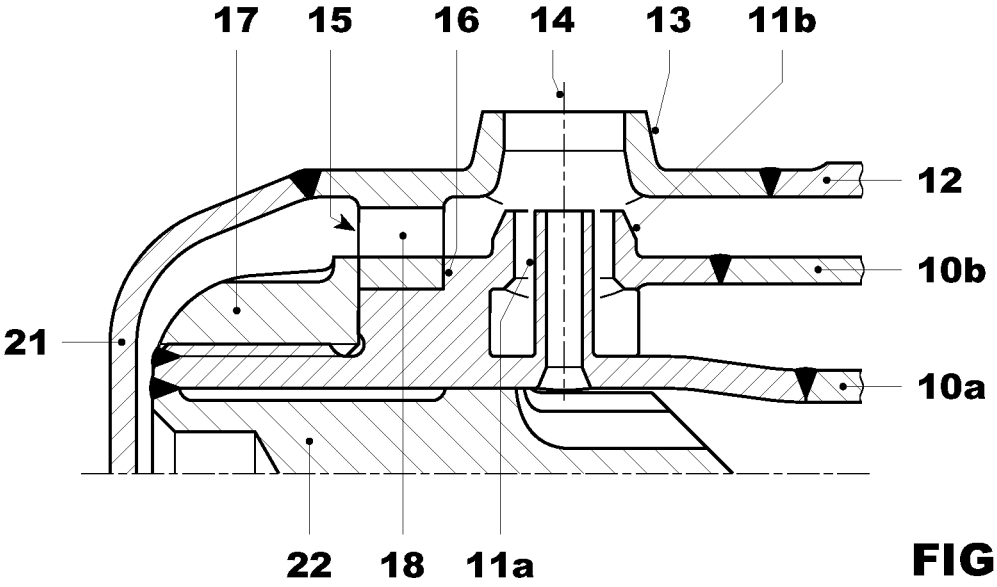
FIG. 6 is a schematic longitudinal section of a terminal portion of a lance in a third embodiment of the invention with a collar extending from an outer duct and two inner ducts.

FIG. 6 shows a third embodiment of the lance 1.

In this embodiment the lance 1 has a first inner duct 10*a* arranged to carry a first fuel (typically liquid fuel) and a second inner duct 10*b* (arranged to carry a second fuel, typically gaseous fuel); the ducts 10*a* and 10*b* are coaxial with each other.

An outer duct 12 encircles both inner ducts 10*a* and 10*b* and is coaxial with them.

Each duct 10*a*, 10*b*, 12 has nozzles 11*a*, 11*b* and 13 having coaxial axes 14.

The embodiment shown in FIG. 6 is shown with collar 15 extending from the outer duct 12, housed in the seat 16 of the inner duct 10*b* and blocked therein by the screwed fixing element 17; the wall 21 is then welded to the outer duct 12.

Naturally also an embodiment with collar 15 extending from the inner duct 10*b* and resting in the seat 16 of the outer duct 12 is possible.

Assembling

Assembling of the lance is apparent from what described and illustrated and is substantially the following (with reference to FIG. 2).

First the terminal portion of the inner duct is welded to the same inner duct 10 (the figures show that the inner duct 10 is made in separate pieces joined together, typically welded).

Thus the terminal portion of the outer duct 12 is inserted above the inner duct 10, the collar 15 is correctly housed in the seat 16, the nozzles 11 and 13 are correctly arranged one respect to the other, and then also this portion is welded to the outer duct 12.

The ring 17 is screwed to the threaded end of the inner duct 10, to block the collar 15 and then also the wall 21 is connected (usually welded) to the outer duct 12.

Assembling of the embodiment of FIG. 4 is evident from what described; in particular the terminal portion of the inner duct 10 is welded first, then its closing element 22 is connected, thus also the terminal portion of the outer duct 12 is connected. Finally the wall 21 and ring 17 are also assembled, by screwing the ring 17 to the corresponding threaded portion of the outer duct 12. A welding may then be realised.

Assembling of the embodiment of FIG. 6 is also evident. In this case the terminal portion of the inner ducts (a block defines the terminal portions of both inner ducts 10*a*, 10*b*) is welded to the inner duct 10*a* first. The closing element 22 and a second welding to connect the terminal portion to the inner duct 10*b* are thus applied. Then the terminal portion of the outer element is welded to the outer duct 12 and, after having screwed the ring 17 to block the collar 15, also the wall 21 in welded to the outer duct 12.

The lance in the embodiments of the invention proved to be very effective, since the collar 15 between the outer and inner ducts 12, 10 is connected (i.e. fixed) to both the inner and outer duct 10, 12 and is blocked in all directions, preventing possible relative deformations that would shift the axes of the inner and outer nozzles 11, 13 from the correct relative position (typically being a coaxial or substantially coaxial relative position).

Naturally the features described may be independently provided from one another.

In practice the materials used and the dimensions can be chosen at will according to requirements and to the state of the art.

REFERENCE NUMBERS

1 channel
1*a* longitudinal axis of the terminal portion of the lance
2 lance
3 vortex generator
10 inner duct
10*a*, 10*b* inner ducts
11 nozzles of 10
11*a*, 11*b* nozzles of 10*a*, 10*b*
12 outer duct
13 nozzles of 12
14 axes of 11, 13
15 spacer/collar
16 seat
17 fixing element
18 through holes of 15
19 slits of 15
20 elements of 15

21 wall
22 closing element
G hot gases

What is claimed is:

1. A lance of a gas turbine burner comprising:

an inner duct having inner nozzles;

an annular outer duct encircling the inner duct and having outer nozzles;

a spacer disposed downstream of the inner nozzles and outer nozzles between a terminal portion of the inner duct and a terminal portion of the outer duct, the spacer being fixed to both the inner duct and the outer duct, and wherein the spacer extends in a radial direction in an annular section between the inner duct and the outer duct;

wherein the inner duct includes an inner duct seat, the spacer extending from the outer duct to the inner duct so as to rest in the inner duct seat, and a fixing element configured to block the spacer in the inner duct seat;

wherein the outer duct includes an outer duct seat, the spacer extending from the inner duct to the outer duct so as to rest in the outer duct seat, and a fixing element configured to block the spacer in the outer duct seat; and a wall closing the terminal portion of the outer duct, wherein the wall is a separate element from the outer duct and connected to the outer duct.

2. The lance as recited in claim 1, wherein the inner nozzle includes an inner axis and the outer nozzle includes an outer axis, each axis having a predefined position relative to one another.

3. The lance as recited in claim 1, wherein the inner duct seat includes a shoulder.

4. The lance as recited in claim 1, wherein the outer duct seat includes a shoulder.

5. The lance as recited in claim 1, wherein the fixing element includes a ring.

6. The lance as recited in claim 1, wherein the fixing element includes a ring.

7. The lance as recited in claim 5, wherein the ring is a threaded ring screwed to a corresponding threaded portion of the terminal portion of the inner duct.

8. The lance as recited in claim 7, wherein the ring extends from the wall.

9. The lance as recited in claim 6, wherein the ring is a threaded ring screwed to a corresponding threaded portion of the terminal portion of the outer duct.

10. The lance as recited in claim 1, wherein the spacer includes a collar.

11. The lance as recited in claim 10, wherein the collar includes through-holes configured to allow air circulating in the outer duct to pass through.

12. The lance as recited in claim 10, wherein the collar includes a plurality of slits defining a plurality of separate elements.

13. The lance as recited in claim 12, wherein each of the plurality of separate elements are equal in size.

14. The lance as recited in claim 1, wherein the spacer includes a collar, and the collar extends from the inner duct to a cylindrical inner surface of the outer duct.

15. The lance as recited in claim 1, wherein the spacer includes a collar, and the collar extends from the outer duct to a cylindrical inner surface on the inner duct.

16. The lance as recited in claim 1, wherein the wall is spaced apart from the inner duct.

17. A lance of a gas turbine burner comprising:

an inner duct having inner nozzles;

an annular outer duct encircling the inner duct and having outer nozzles;

a spacer disposed downstream of the inner nozzles and outer nozzles between a terminal portion of the inner duct and a terminal portion of the outer duct, the spacer being fixed to both the inner duct and the outer duct, and wherein the spacer extends in a radial direction in an annular section between the inner duct and the outer duct;

wherein the inner duct includes an inner duct seat, the spacer extending from the outer duct to the inner duct so as to rest in the inner duct seat, and a fixing element configured to block the spacer in the inner duct seat;

wherein the outer duct includes an outer duct seat, the spacer extending from the inner duct to the outer duct so as to rest in the outer duct seat, and a fixing element configured to block the spacer in the outer duct seat; and a wall closing the terminal portion of the outer duct.

18. The lance as recited in claim 1, wherein the inner nozzle includes an inner axis and the outer nozzle includes an outer axis, each axis having a predefined position relative to one another, and wherein the inner and the outer axes are one of coaxial axes and shifted axes with respect to one another.

* * * * *